US012551809B2

(12) United States Patent
Richter et al.

(10) Patent No.: US 12,551,809 B2
(45) Date of Patent: Feb. 17, 2026

(54) ACTIVE AERIAL DESCENT DEVICES AND SYSTEMS

(71) Applicants: Elizabeth Mary Richter, Atlanta, GA (US); Elizabeth Anastasia Stinespring, Atlanta, GA (US); Matthew Lawson Braun, Atlanta, GA (US)

(72) Inventors: Elizabeth Mary Richter, Atlanta, GA (US); Elizabeth Anastasia Stinespring, Atlanta, GA (US); Matthew Lawson Braun, Atlanta, GA (US)

( * ) Notice: Subject to any disclaimer, the term of this patent is extended or adjusted under 35 U.S.C. 154(b) by 194 days.

(21) Appl. No.: 18/461,624

(22) Filed: Sep. 6, 2023

(65) Prior Publication Data

US 2024/0082746 A1 Mar. 14, 2024

Related U.S. Application Data

(60) Provisional application No. 63/405,579, filed on Sep. 12, 2022.

(51) Int. Cl.
*A63H 27/00* (2006.01)
*A63H 33/20* (2006.01)

(52) U.S. Cl.
CPC ..... *A63H 27/005* (2013.01)

(58) Field of Classification Search
CPC ..... F42B 10/00; F42B 10/56; F42B 10/58; A63H 27/005; A63H 33/20; B64U 10/20; B64U 10/80; B64U 30/29; B64U 30/293; B64U 50/13; B64U 50/19; B64U 70/20; B64U 70/80; B64U 70/83; B64D 19/02; B64D 17/80
USPC ..... 446/34, 36, 52, 53, 57; 244/138 R, 244/138 A, 142; 102/339, 340, 348, 354, 102/387, 388; 416/142, 141
See application file for complete search history.

(56) References Cited

U.S. PATENT DOCUMENTS 1,003,082 A * 9/1911 Ziegenfuss ..... F42B 4/26 102/338
1,537,713 A * 5/1925 Sperry ..... F42B 10/56 244/152
1,673,233 A * 6/1928 La Cierva ..... B64C 27/023 244/17.11
1,799,664 A * 4/1931 Williams ..... B64D 19/02 244/138 A
1,811,867 A * 6/1931 Serragli ..... B64C 27/021 244/138 A
1,867,714 A * 7/1932 Shippee ..... A63H 27/12 446/40
1,880,586 A * 10/1932 Tiling ..... F42B 10/30 244/74
1,964,016 A * 6/1934 Wiley ..... F42B 4/28 102/354

(Continued)

*Primary Examiner* — Alexander R Niconovich
(74) *Attorney, Agent, or Firm* — Meunier Carlin & Curfman LLC

(57) ABSTRACT

Various implementations include aerial descent devices including a body, at least two arms, and at least two propellers. The body includes a first disc piece, a second disc piece, and a core disposed between and coupling the first disc piece to the second disc piece. The at least two arms each have a first end and a second end, and the at least two propellers are coupled to the second end of each of the at least two arms wherein the first end of each of the arms are pivotally coupled to the core of the body.

19 Claims, 5 Drawing Sheets

(56) References Cited

U.S. PATENT DOCUMENTS 2,329,414 A * 9/1943 Nelson ..... F42B 10/58 244/1 R
2,334,028 A * 11/1943 Raio ..... B64C 23/005 416/142
2,440,291 A * 4/1948 Pitcairn ..... F42B 10/58 244/138 A
2,440,292 A * 4/1948 Pitcairn ..... F42B 10/58 244/138 A
2,440,293 A * 4/1948 Stanley ..... F42B 10/58 244/138 A
2,440,294 A * 4/1948 Campbell ..... F42B 10/58 244/138 A
2,440,296 A * 4/1948 Perry ..... F42B 10/58 310/40 MM
2,442,528 A * 6/1948 Beattle ..... F42B 4/12 102/357
2,841,084 A * 7/1958 Carlisle ..... A63H 33/20 446/52
3,646,887 A * 3/1972 Stine ..... F42B 15/36 446/52
3,719,145 A * 3/1973 Brown et al. ..... F42B 15/36 102/351
3,838,940 A * 10/1974 Hollrock ..... B64D 19/02 416/142
4,356,662 A * 11/1982 Strasser ..... A63H 27/14 446/52
H776 H * 5/1990 Cole ..... F42B 10/54 102/388
5,054,397 A * 10/1991 Hans ..... F42B 10/56 446/52
5,232,184 A * 8/1993 Reuter ..... B64D 17/64 244/148
6,565,041 B1 * 5/2003 Young ..... B64D 17/54 244/139
6,712,317 B1 * 3/2004 Warren ..... B64D 19/00 244/142
7,752,973 B2 * 7/2010 Zahn ..... F42B 4/28 102/354
8,006,936 B1 * 8/2011 Farr, III ..... B64G 1/002 244/151 B
10,054,939 B1 * 8/2018 Applewhite ..... B64U 10/10
10,946,705 B1 * 3/2021 Neuman ..... B64C 29/02
11,091,265 B1 * 8/2021 Newsted ..... B64D 19/02
11,806,637 B2 * 11/2023 Frawley ..... A63H 27/005
12,257,522 B2 * 3/2025 VanStavern ..... A63H 27/005
2009/0283629 A1 * 11/2009 Kroetsch ..... B64U 20/40 244/17.23
2016/0046372 A1 * 2/2016 Barnes ..... B64U 10/14 244/17.19
2025/0051007 A1 * 2/2025 Ifill ..... B64U 30/24
2025/0153871 A1 * 5/2025 Liu ..... B64U 10/14

* cited by examiner

ACTIVE AERIAL DESCENT DEVICES AND SYSTEMS

CROSS-REFERENCE TO RELATED APPLICATIONS

This application claims priority to U.S. Provisional Patent Application No. 63/405,579, filed Sep. 12, 2022, which is incorporated herein by reference.

BACKGROUND

Model Rockets typically expel a parachute that slows and cushions their descent to the ground after hitting the apex of their launch. If the wind conditions are unfavorable to the launch trajectory, the entire model rocket can be lost in a tree or otherwise unrecoverable. Accordingly, there remains a need for a way for a model rocket user to guide their rocket back to the ground after launch.

BRIEF DESCRIPTION OF DRAWINGS

Example features and implementations are disclosed in the accompanying drawings. However, the present disclosure is not limited to the precise arrangements and instrumentalities shown.

SUMMARY

Figure 1:
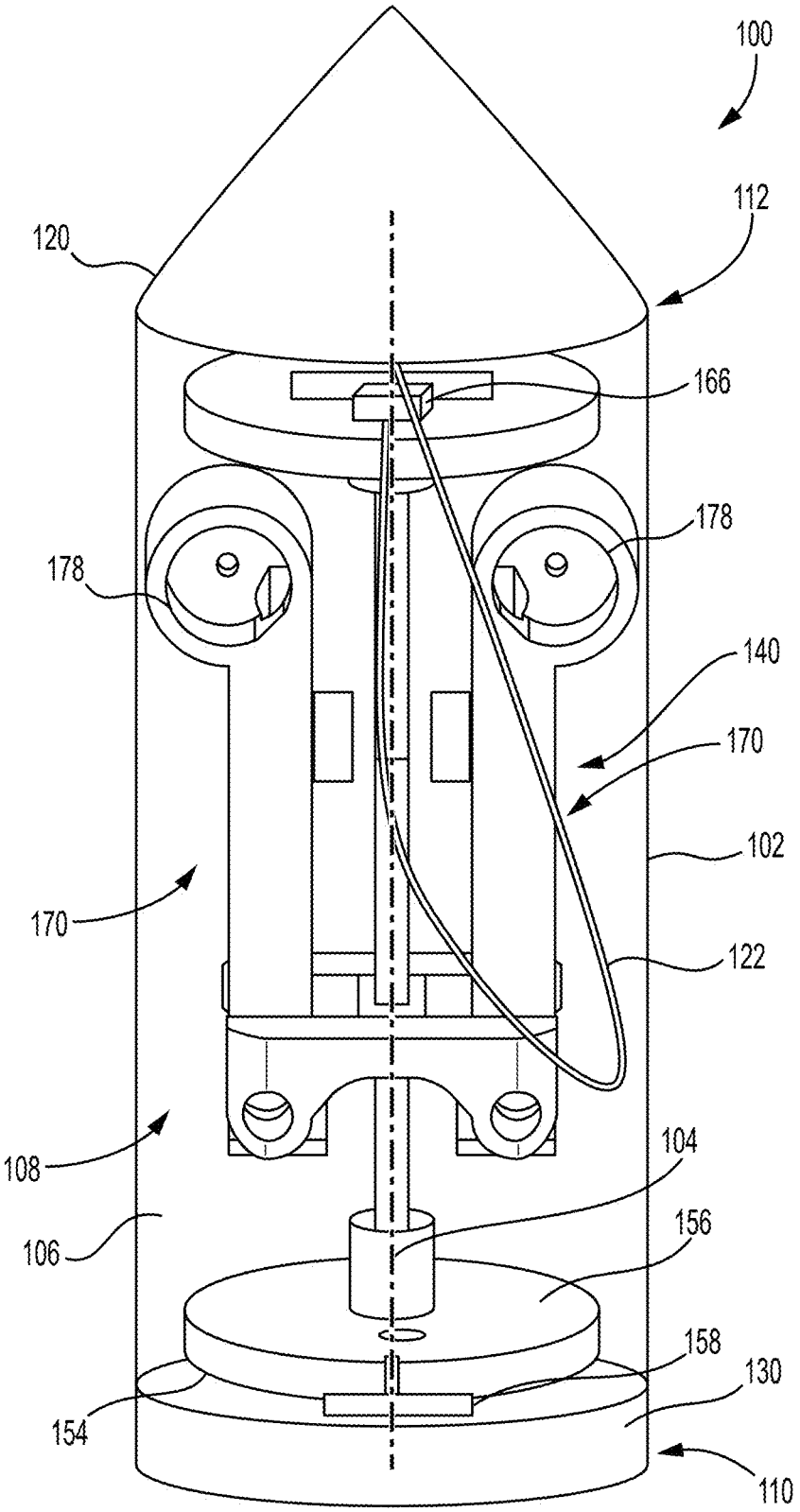
FIG. 1 illustrates a front view of an implementation of an aerial descent device within an aerial system.

In accordance with the purposes of the disclosed materials and methods, as embodied and broadly described herein, the disclosed subject matter, in one aspect, relates to an aerial descent device comprising a body comprising a first disc piece, a second disc piece, and a core disposed between and coupling the first disc piece to the second disc piece; at least two arms each having a first end and a second end; and at least two propellers, each propeller being coupled to the second end of each of the at least two arms; wherein the first end of each of the arms are pivotally coupled to the core of the body. In another embodiment, disclosed is an aerial descent system comprising a tube defining a cylindrical cavity and having a first end and a second end; an aerial descent device comprising a body comprising a first disc piece, a second disc piece, and a core disposed between and coupling the first disc piece to the second disc piece, at least two arms each having a first end and a second end, the first end of each of the arms being coupled to the body, at least two propellers, each propeller being coupled to the second end of each of the at least two arms, and a parachute coupled to the second disc piece. The parachute can be coupled to shroud lines, which can be coupled to a shock cord that is attached to eye hooks on the second disc piece. The aerial decent device is removable disposed within the cylindrical cavity of the tube.

Additional advantages will be set forth in part in the description that follows, and in part will be obvious from the description, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

DETAILED DESCRIPTION

Various implementations of the devices and systems disclosed herein provide for an aerial descent devices including a body, at least two arms, and at least two propellers. The body includes a first disc piece, a second disc piece, and a core disposed between and coupling the first disc piece to the second disc piece. The at least two arms each have a first end and a second end, and the at least two propellers are coupled to the second end of each of the at least two arms wherein the first end of each of the arms are pivotally coupled to the core of the body.

For example, according to various implementations, the at least two arms are diametrically opposed to each other.

In some implementations, each of the at least two propellers comprise a propeller motor. In some implementations, the aerial descent device includes an electronic receiver coupled to the body in electric communication with the propeller motors. In some implementations, the electronic receiver is coupled to the second disc piece of the body. In some implementations, the aerial descent device includes a speed controller coupled to the body and corresponding to at least one of the propeller motors. In some implementations, the aerial descent device includes an electronic controller that is in wireless electrical communication with the electronic receiver.

In some implementations, the aerial descent device includes a parachute coupled to the second disc piece. The parachute can be connected to the second disc piece through shroud lines connected to the parachute and which are also connected to a shock cord that is connected to an eye hook on the second disc piece.

In some implementations, the first disc piece has a first diameter, and the second disc piece has a second diameter, and wherein the first diameter is equal to the second diameter.

In some implementations, the aerial descent device includes at least one ring disposed on either the first disc piece or the second disc piece.

Various other implementations include an aerial descent system that includes a tube, an aerial descent device, and a parachute. The tube defines a cylindrical cavity and has a first end and a second end. The aerial descent device includes a body, at least two arms, and at least two propellers. The body includes a first disc piece, a second disc piece, and a core disposed between and coupling the first disc piece to the second disc piece. The at least two arms each have a first end and a second end. The first end of each of the arms is coupled to the body. Each propeller is coupled to the second end of each of the at least two arms. The parachute is coupled to the shock cord, which is coupled to the second disc piece. The aerial descent device is removably disposed within the cylindrical cavity of the tube.

In some implementations, an interior of the tube contacts and holds the at least two arms toward the core of the aerial descent device when the aerial descent device is disposed within the tube.

In some implementations, the first ends of the at least two arms are pivotally coupled to the core such that when the aerial descent device is removed from the tube, the at least two arms fall away from the core.

In some implementations, the aerial descent system includes a nose cone that is removably coupled to the tube. In some implementations, the nose cone is partially disposed within the cylindrical opening at the second end of the tube. In some implementations, the aerial descent system further includes a shock cord that couples the nose cone to the second disc piece.

In some implementations, the aerial descent system further includes shroud lines that couple the parachute to the shock cord.

In some implementations, the aerial descent system further includes a rocket motor, that is disposed within the first end of the cylindrical cavity of the tube.

In some implementations, the first disc piece has a first diameter that corresponds with a diameter of the cylindrical cavity of the tube, and the second disc piece has a second diameter, and wherein the first diameter is equal to the second diameter.

In some implementations, the at least two arms are diametrically opposed to each other.

In some implementations, the aerial descent system includes an electronic receiver coupled to the body, and an electronic controller. In some implementations, the electronic controller is in wireless electronic communication with the electronic receiver.

Various other implementations include a system that includes the aerial descent system and the aerial descent device described above.

Referring now to the figures, FIG. 1 shows an example aerial descent system 100 according to one implementation. The aerial descent system 100 shown in FIG. 1 includes a tube 102, a nose cone 120, a rocket motor 130, and an aerial descent device 140. In FIG. 1, the rocket motor 130 is shown close to the aerial decent device 140 for convenience, but in an actual system (e.g., a longer rocket), the rocket motor 130 is at one end of a longer tube 102 and thus can be a further distance away from the aerial decent device 140 at the other end of the tube 102. The tube 102 has a longitudinal axis 104 and an interior surface 106. The tube 102 defines a cylindrical cavity 108 having a first cylindrical cavity end 110, and a second cylindrical cavity end 112. The first cylindrical cavity end 110 and the second cylindrical cavity end 112 are opposite and linearly spaced apart from each other along the longitudinal axis 104 of the tube 102. The tube 102 maintains its shape along the longitudinal axis 104 such that the diameter of the second cylindrical cavity end 112 is equal to the diameter at the first cylindrical cavity end 110. The tube 102 in the implementations shown is fiberglass, however, in other implementations, the tube 102 is cardboard or any other lightweight structural material.

The nose cone 120 is removably coupled to the tube 102 such that the nose cone 120 is partially disposed within the second cylindrical cavity end 112 with an interference fit. The nose cone 120 is further attached to the aerial descent device 140 with a shock cord 122. The shock cord 122 can be any durable cord material, such as nylon cord, paracord, or elastic cord.

The rocket motor 130 is fixedly disposed within the first cylindrical cavity end 110 by the motor retention mechanism (not shown), which can include retention rings or a metal retention stop, depending on the rocket's design. The rocket motor can be a G-40-7(W) motor, but in other implementations, the rocket motor can be any motor of size G or larger. When a lighter rocket is desired, size F motors could be used.

The aerial descent device 140 includes a body 150, two arms 170, and two propellers 188. The body 150 includes a first disc piece 152, a second disc piece 160, and a core 168 disposed between and fixedly coupling the first disc piece 152 to the second disc piece 160.

The first disc piece 152 has a first diameter, and the second disc piece 160 has a second diameter. The first diameter of the first disc piece 152 is equal to the second diameter of the second disc piece 160 and of the second cylindrical cavity end 112 of the tube 102 so that when the aerial descent device 140 expels from the tube 102 of the aerial descent system 100, a retention system is necessary. A line of paracord connects the bottom disc piece 152 to a point on the tube 102 above the motor 130 using eye hook(s). The paracord is adjusted to a length that causes the bottom portion of the aerial descent device to remain inside of the tube 102. This allows the arms 170 to be deployed/extended while keeping the power source 158 safely in the rocket as the parachute 192 deploys.

Alternative designs can employ tracks on the inside of the tube 102 on opposite sides that fit into notches in the disc pieces 152 and 160. This would prevent lateral movement of the aerial descent device 140 for more efficient guidance. In some implementations, the second disc piece 160 includes notches cut out from the edge of the disc adjacent interior surface 106 of the tube 102, and the interior surface 106 of the tube 102 includes corresponding protrusions sticking out into the cylindrical cavity 108. Thus, in some implementations, the notches and corresponding protrusions align such that the second disc piece 160 may freely move passed the notches while the first disc piece 152 is retained within the cylindrical cavity 108 by the protrusions.

The first disc piece 152 further includes a first surface 154 and a second surface 156. The first surface 154 is adjacent to the rocket motor 130 and includes a power source 158 fixedly attached to the first surface 154 of the first disc piece 152. The second surface of the first disc piece is adjacent to the core.

Figure 2:
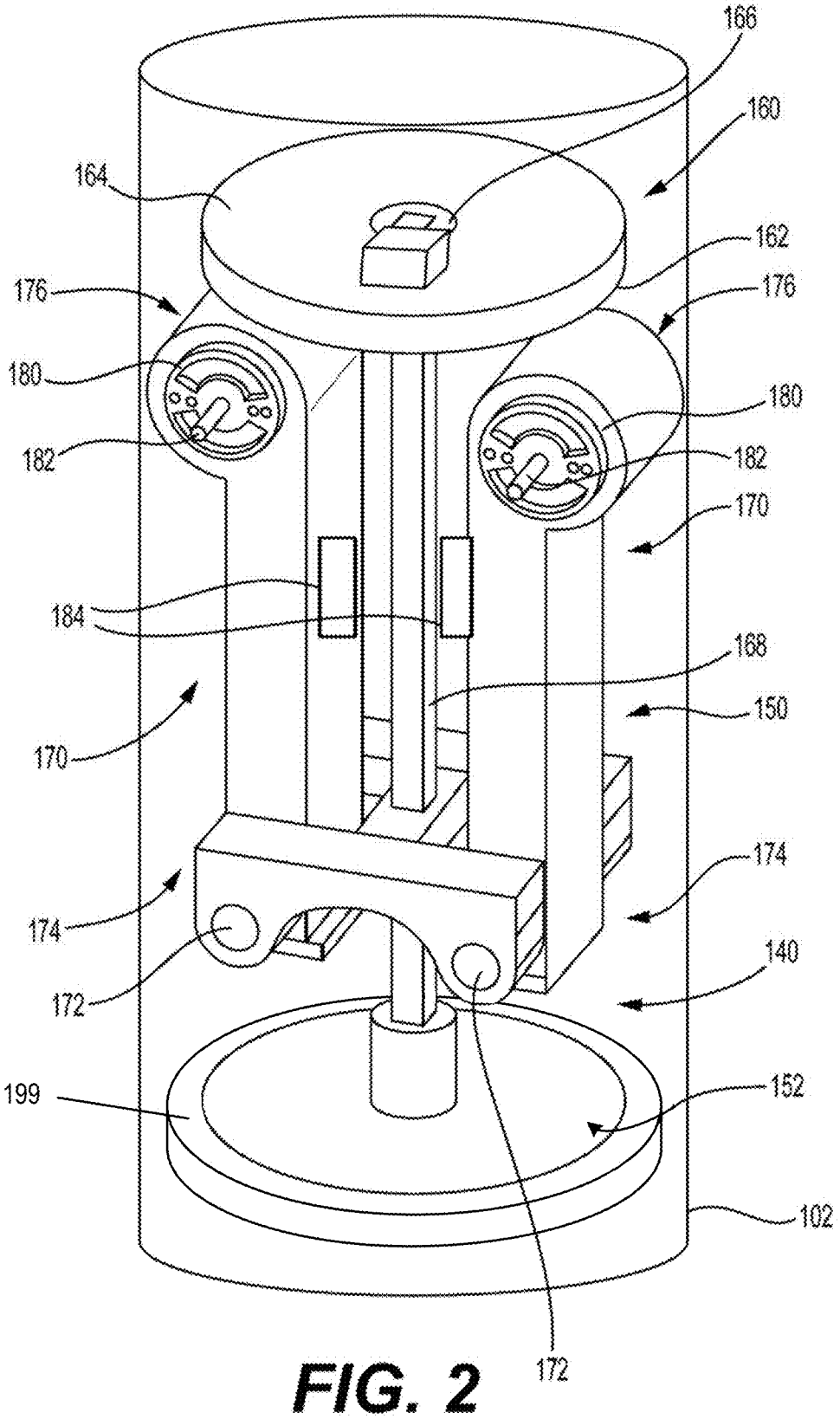
FIG. 2 illustrates a perspective view of the implementation of the aerial system of FIG. 1 with propeller motors in the aerial descent device.

Although the core 168 in the implementation shown in FIG. 2 fixedly couples the first disc piece 152 and the second disc piece 160, in other implementations, the core removably couples the first disc piece 152 to the second disc piece 160 such that the disc pieces can be replaced with a variety of sizes corresponding to the diameter of the tube 102.

The two arms 170 are pivotally coupled to the core 168 of the body 150 with fixed steel pins driven through mounting points on the central body into the holes at the base of the arms 170, creating fixed axles 172, and diametrically opposed to one another. Both arms 170 have a first end 174 and second end 176 with the first ends 174 being pivotally coupled to the core 168 and the second ends 176 defining a motor cavity 178. Both arms 170 further include a propeller motor 180 disposed within the motor cavities 178 as shown in FIG. 2. The propeller motors 180 each include a motor axle 182 that couples the motors 180 to the propellers 188. In some implementations, the motors 180 are secured within the motor cavities 178 using one or more long screws and a metal washer assembly, enabling easy removal and replacement of each motor 180.

The propeller motors 180 are tracked by the speed controllers 184 attached to each of the arms. The speed controllers 184 shown are FT 35A electronic speed controllers (ESCs) with XT60 connectors and are glued to each of the arms, however, in some other implementations, the speed controllers 184 are any pre-existing electronic speed controllers and can be mechanically coupled through screws put directly into the arms with a protective covering. In other implementations, the device can be equipped with GPS trackers, an altimeter, and/or an audio homing device, each of which can be located on the body 150 or arms 170. The arms 170 can contain a variety of openings 186 to run wires to the speed controllers 184, electronic receiver 166, and propeller motors 180. Also in other implementations, the aerial descent device 140 can include two, three, four, or more arms pivotally coupled to the core 168 of the body 150.

Figure 3:
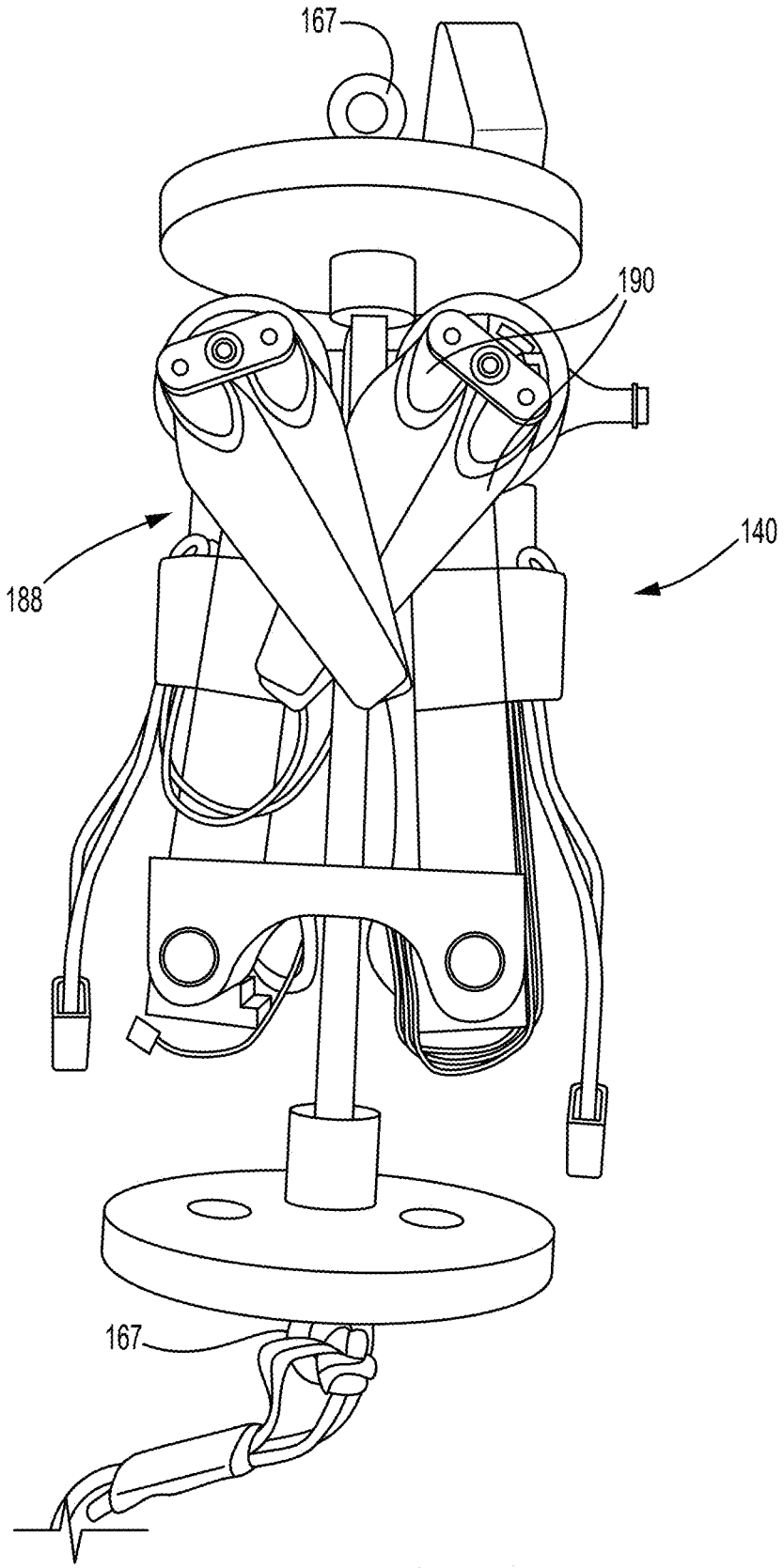
FIG. 3 illustrates a front view of the aerial descent device of FIG. 1 with propeller motors and propellers.

Each of the propellers 188 as shown in FIG. 3 includes two blades 190. The two blades 190 are disposed on the motor axles 182 and rotate with the motor axle 182 when it is activated by the corresponding propeller motor 180. The two blades 190 are oriented parallel to the longitudinal axis 104 of the tube 102 of the aerial descent device 140 such that the blades 190, when rotating, affect the horizontal motion of the landing of the aerial descent system 100. In other implementations, the propeller number or orientation can vary from being parallel to being at an angle from the longitudinal axis 104 of the tube 102 to provide a small amount of vertical lift to the landing system.

The second disc piece 160 includes a first surface 162 and a second surface 164 opposite and spaced apart from the first surface 162. The first surface 162 is adjacent the core 168. The second surface 164 is opposite the core 168 and includes an electronic receiver 166 that is in electrical communication with the propeller motors 180, the speed controllers 184, and an external electronic controller. In some implementations, the second surface 164 of the second disc piece 160 includes a retention member or retention clip to secure the electronic receiver 166 to the second disc piece 160. For example, a retention member may include an L-shaped metal prong fixed to the second disc piece 160 with a swinging latch configured to enclose the electronic receiver 166. In another example, the retention member may include one or more upside down L-shaped metal prongs configured to latch together to prevent the electronic receiver 166 from falling off. The external electronic controller has the capabilities of changing the speed of and direction of the rotation of each of the propeller motors 180. The electronic controller can be a SPEKTRUM DXe remote controller bound to a Spektrum AR410 4-channel DSMX Aircraft Receiver and is in wireless communication with the electronic receiver.

Figure 4:
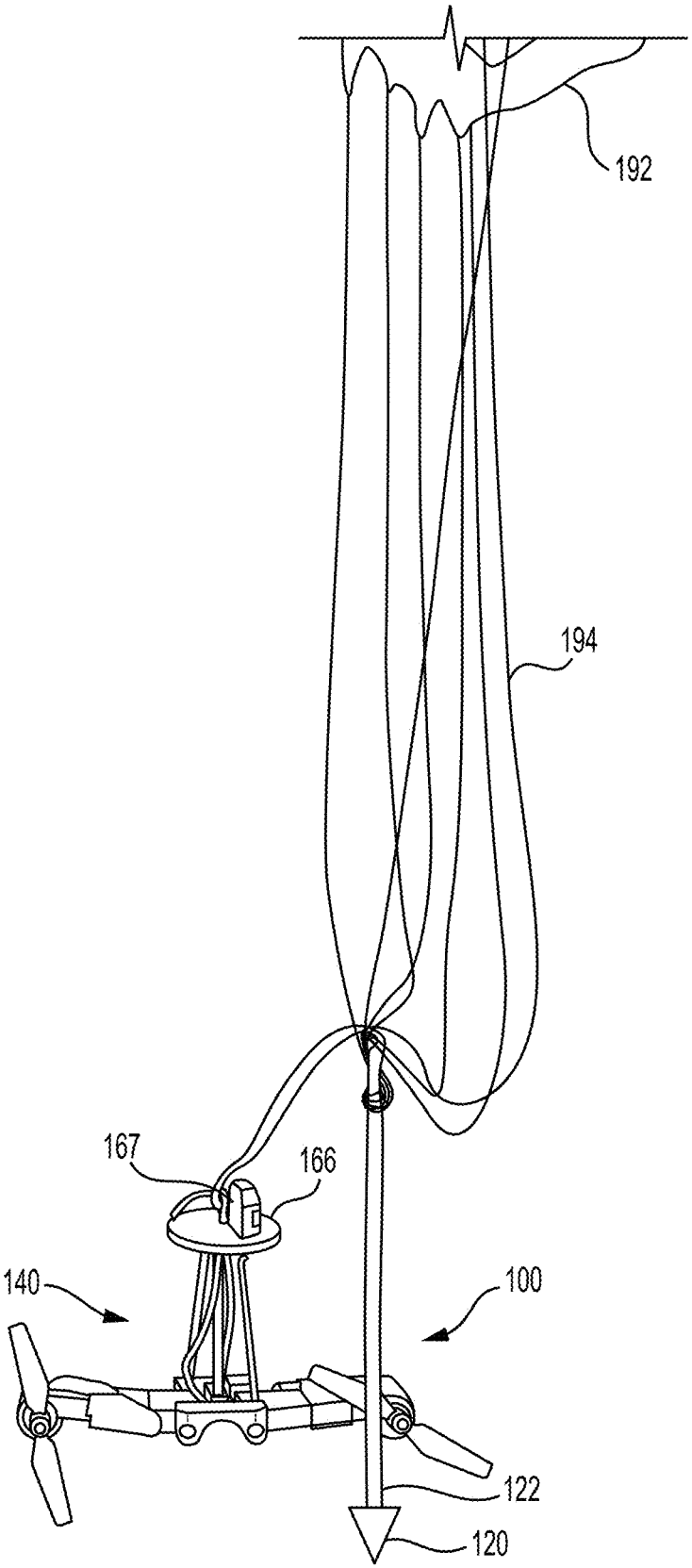
FIG. 4 illustrates the aerial system of FIG. 1.
Figure 5:
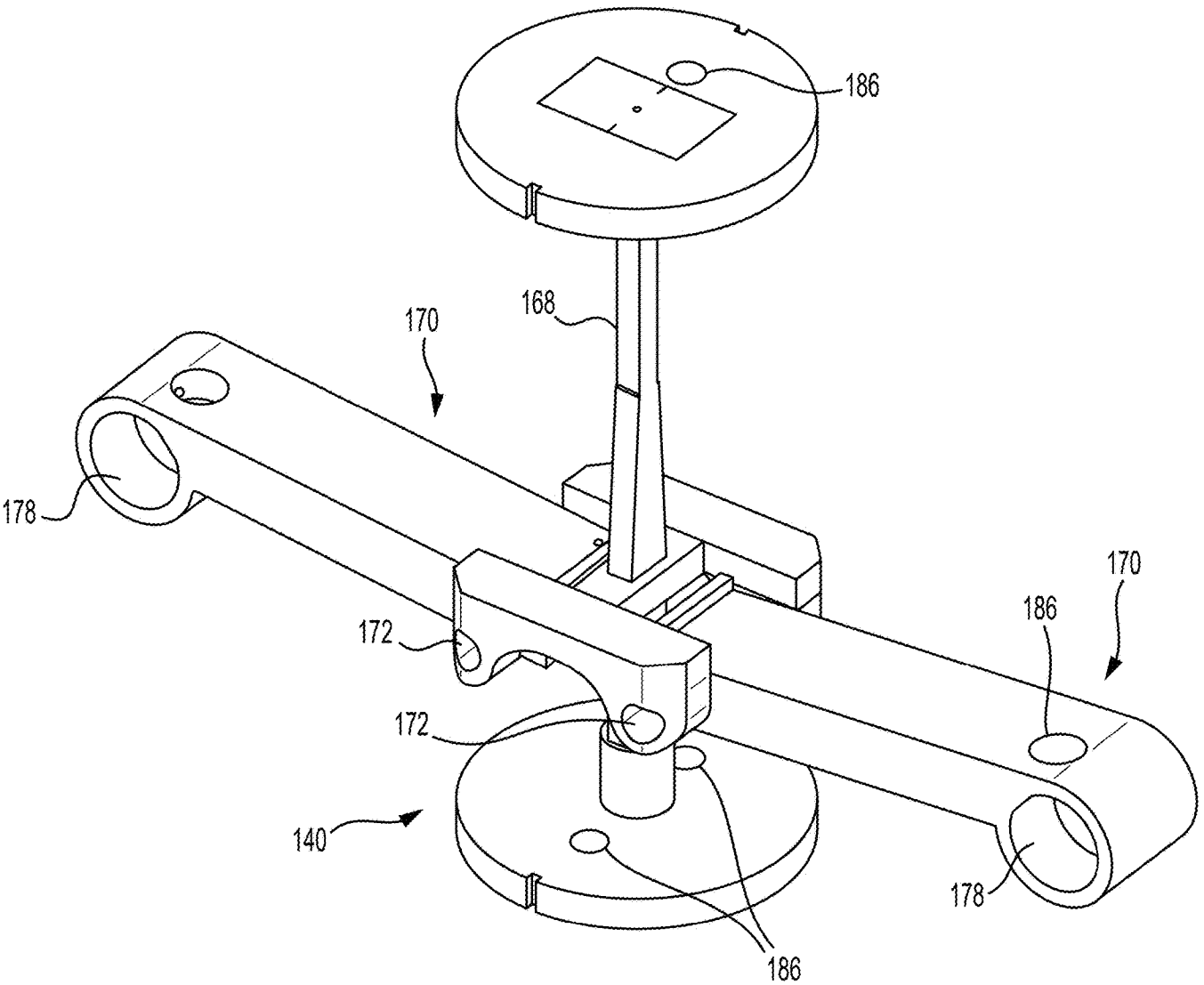
FIG. 5 illustrates a perspective view of the aerial descent device of FIG. 1.

The second surface 164 of the second disc piece 160 is fixedly coupled to the nose cone 120 through the shock cord 122. In some implementations, as shown in FIGS. 4 and 5, the second surface 164 of the second disc piece 160 further includes an eye hook 167 that attaches the shock cord 122 to the second surface 164 of the second disc piece 160. The shroud lines 194 attach to the shock cord 122 and subsequently couple the parachute 192 to the aerial descent device 140.

Prior to launch, the aerial descent device 140 is disposed within the tube 102 and the interior of the tube 102 contacts and holds the arms 170 toward the core 168 of the aerial descent device 140. After launch, when the aerial descent system 100 hits the apex/apogee of its ascension, the nose cone 120 uncouples from the tube 102 and pulls the parachute 192 and the aerial descent device 140 out of the tube 102. Notably, the first disc piece 152 of the aerial descent device 140 is retained in the tube 102 such that the aerial descent device 140 remains coupled to the tube 102. The device 140 is retained by a cord connected from the internal surface of the tube 102 below the device to the eye hook 167 on the bottom of the first disc piece 152. When the aerial descent device 140 is out of the tube 102, the arms 170 fall away from the core 168 such that they are substantially perpendicular to the tube 102 as shown in FIG. 4. While the parachute 192 controls the vertical displacement of the aerial descent system 100, the aerial descent device 140, through the external controller, can be turned on and used to change the horizontal displacement of the aerial descent system 100. The aerial descent system 100 ensures that the user can change the landing location to be closer to the user or to avoid trees, buildings, or similar hazards that could lead to not being able to retrieve the aerial descent system 100.

In some implementations, to be adjustable for varying diameters of tubes 102 in different aerial descent systems 100, the aerial descent device 140 includes a removable ring 199 that can be disposed about the first disc piece 152 of the aerial descent device 140. The removable ring 199, when disposed around the first disc piece 152, will permit the device to be securely inserted into a larger tube 102. In some implementations, the aerial descent device 140 includes another removable ring disposable about the second disc piece 160 to increase the diameter of the second disc piece 160 such that the aerial descent system 100 is not angled within the tube 102 or prone to becoming stuck within the tube 102. The purpose of the removable rings is to increase the diameter of the disc pieces so that, when used in a rocket with a larger tube diameter, the device will be secure in the rocket body.

What is claimed is:

1. An aerial descent device for a model rocket, the device comprising:

a body comprising a first disc piece, a second disc piece, and a core disposed between and coupling the first disc piece to the second disc piece, wherein the first and second disc pieces are spaced apart along a primary longitudinal axis of the body;

at least two arms each having a first end and a second end, wherein the first end of each of the arms are pivotally coupled to the core of the body; and at least two propellers, each propeller being coupled to the second end of each of the at least two arms, wherein each of the at least two propellers comprises a propeller motor;

wherein the at least two arms are moveable between a stored configuration and a deployed configuration, wherein, in the deployed configuration, the at least two propellers are oriented to rotate about a rotational axis that is perpendicular to the primary longitudinal axis of the body to affect horizontal displacement of the aerial descent device.

2. The device of claim 1, wherein the at least two arms are diametrically opposed to each other.

3. The device of claim 1, further comprising an electronic receiver coupled to the body in electric communication with the propeller motors.

4. The device of claim 3, wherein the electronic receiver is coupled to the second disc piece of the body.

5. The device of claim 3, further comprising a speed controller coupled to the body and corresponding to at least one of the propeller motors.

6. The device of claim 3, further comprising an electronic controller, the electronic controller being in wireless electrical communication with the electronic receiver.

7. The device of claim 1, further comprising a parachute coupled to the second disc piece and shroud lines coupled to the parachute.

8. The device of claim 7, further comprising a shock cord coupled to the shroud lines, wherein the shock cord is attached to the second disc piece.

9. The device of claim 1, wherein the first disc piece has a first diameter, and the second disc piece has a second diameter, and wherein the first diameter is equal to the second diameter.

10. The device of claim 1, further comprising at least one ring disposable on either the first disc piece or the second disc piece, the at least one ring being adjustable to match a diameter of a tube and to securely align the device within the tube.

11. An aerial descent system for a model rocket, the system comprising:

a tube defining a cylindrical cavity and having a first end and a second end;

an aerial descent device comprising a body comprising a first disc piece, a second disc piece, and a core disposed between and coupling the first disc piece to the second disc piece, wherein the first and second disc pieces are spaced apart along a primary longitudinal axis of the body, at least two arms each having a first end and a second end, the first end of each of the arms being pivotally coupled to the core of the body, and at least two propellers, each propeller being coupled to the second end of each of the at least two arms, wherein each of the at least two propellers comprises a propeller motor, wherein the at least two arms are moveable between a stored configuration and a deployed configuration, wherein, in the deployed configuration, the at least two propellers are oriented to rotate about a rotational axis that is perpendicular to the primary longitudinal axis of the body to affect horizontal displacement of the aerial descent device; and a parachute coupled to the second disc piece, wherein the aerial descent device is removably disposed within the cylindrical cavity of the tube.

12. The system of claim 11, wherein an interior of the tube contacts and holds the at least two arms toward the core of the aerial descent device when the aerial descent device is disposed within the tube.

13. The system of claim 12, wherein the at least two arms are diametrically opposed to each other, wherein the first ends of the at least two arms are pivotably coupled to the core such that when the aerial descent device is removed from the tube, the at least two arms fall away from the core.

14. The system of claim 13, further comprising a nose cone, wherein the nose cone is removably coupled to the tube and partially disposed within the cylindrical cavity at the second end of the tube.

15. The system of claim 14, further comprising a shock cord, wherein the shock cord couples the nose cone to the second disc piece.

16. The system of claim 15, further comprising shroud lines, wherein the shroud lines couple the parachute to the shock cord; and the shock cord couples to the shroud lines to the second disc piece.

17. The system of claim 11, further comprising a rocket motor, wherein the rocket motor is disposed within the first end of the cylindrical cavity of the tube.

18. The system of claim 11, wherein the first disc piece has a first diameter that corresponds with a diameter of the cylindrical cavity of the tube, and the second disc piece has a second diameter, and wherein the first diameter is equal to the second diameter the second diameter.

19. The system of claim 11, further comprising an electronic receiver coupled to the body, and an electronic controller, wherein the electronic controller is in wireless electronic communication with the electronic receiver.

* * * * *